US011129416B2

(12) United States Patent
Yuan

(10) Patent No.: US 11,129,416 B2
(45) Date of Patent: Sep. 28, 2021

(54) ELECTRONIC CIGARETTE

(71) Applicant: Ygreen Inc., Walnut, CA (US)

(72) Inventor: Guolin Yuan, Walnut, CA (US)

(73) Assignee: Ygreen, Inc., Walnut, CA (US)

( * ) Notice: Subject to any disclaimer, the term of this patent is extended or adjusted under 35 U.S.C. 154(b) by 61 days.

(21) Appl. No.: 16/693,662

(22) Filed: Jan. 7, 2020

(65) Prior Publication Data

US 2020/0170299 A1 Jun. 4, 2020

(30) Foreign Application Priority Data

Dec. 3, 2018 (CN) ..... 201822021813.5

(51) Int. Cl.
*A24F 40/46* (2020.01)
*A24F 40/44* (2020.01)

(52) U.S. Cl.
CPC ..... *A24F 40/46* (2020.01); *A24F 40/44* (2020.01)

(58) Field of Classification Search
None
See application file for complete search history.

(56) References Cited

U.S. PATENT DOCUMENTS

| | | | | |
|---|---|---|---|---|
| 10,945,455 | B1 * | 3/2021 | Wang | A24F 40/46 |
| 2016/0100633 | A1 | 4/2016 | Gao | |
| 2016/0157522 | A1 | 6/2016 | Zhu | |
| 2016/0360790 | A1 | 12/2016 | Calfee | |
| 2017/0208870 | A1 | 7/2017 | Liu | |
| 2018/0027874 | A1 * | 2/2018 | Zhu | F22B 1/284 |
| 2019/0200676 | A1 | 7/2019 | Crowe | |
| 2020/0170299 | A1 * | 6/2020 | Yuan | A24F 40/485 |

(Continued)

FOREIGN PATENT DOCUMENTS

| | | | |
|---|---|---|---|
| CN | 204579895 | U | 8/2015 |
| CN | 207590083 | U | 7/2018 |
| EP | 3257387 | A1 | 12/2017 |

(Continued)

OTHER PUBLICATIONS

Klinteback, Daniel, Search Report and Written Opinion for EP application 19168340.8-1006 , dated Jul. 4, 2019, pp. 8, European Patent Office, Munich Germany.

(Continued)

*Primary Examiner* — James Harvey
(74) *Attorney, Agent, or Firm* — Schneider IP Law LLC; Laura A. Schneider

(57) ABSTRACT

An electronic cigarette has an installing cavity formed at a bottom of the oil chamber, and a first internal thread arranged on an inner wall of the installing cavity. The glass guiding pipe has a pipe body and a flange sleeved and fixed on the pipe body, a first external thread connected with the first internal thread is arranged on a lateral side of the flange. The atomization core has a glass heating coil and an atomizing medium arranged at a top of the glass heating coil. Oil guiding holes are arranged on the flange, the oil guiding holes guide oil to the atomization core. An opening corresponding to the oil guiding hole is arranged on an inner wall of the oil chamber. A through-hole corresponding to the pipe body is arranged through a lengthways in the oil chamber, the through-hole connected with the installing cavity.

10 Claims, 1 Drawing Sheet

(56) References Cited

U.S. PATENT DOCUMENTS

2020/0323042 A1* 10/2020 Guo ..... H05B 1/0227

FOREIGN PATENT DOCUMENTS

| | | | |
|---|---|---|---|
| EP | 006754958-0001 | | 8/2019 |
| EP | 006754958-0002 | | 8/2019 |
| WO | 2016169119 | A1 | 10/2016 |
| WO | 2018032672 | A1 | 2/2018 |

OTHER PUBLICATIONS

Dartis, Daniel, Search Report for EP application EP 19 211 596.2, dated Mar. 26, 2020 pp. 6, European Patent Office, Munich Germany.

* cited by examiner

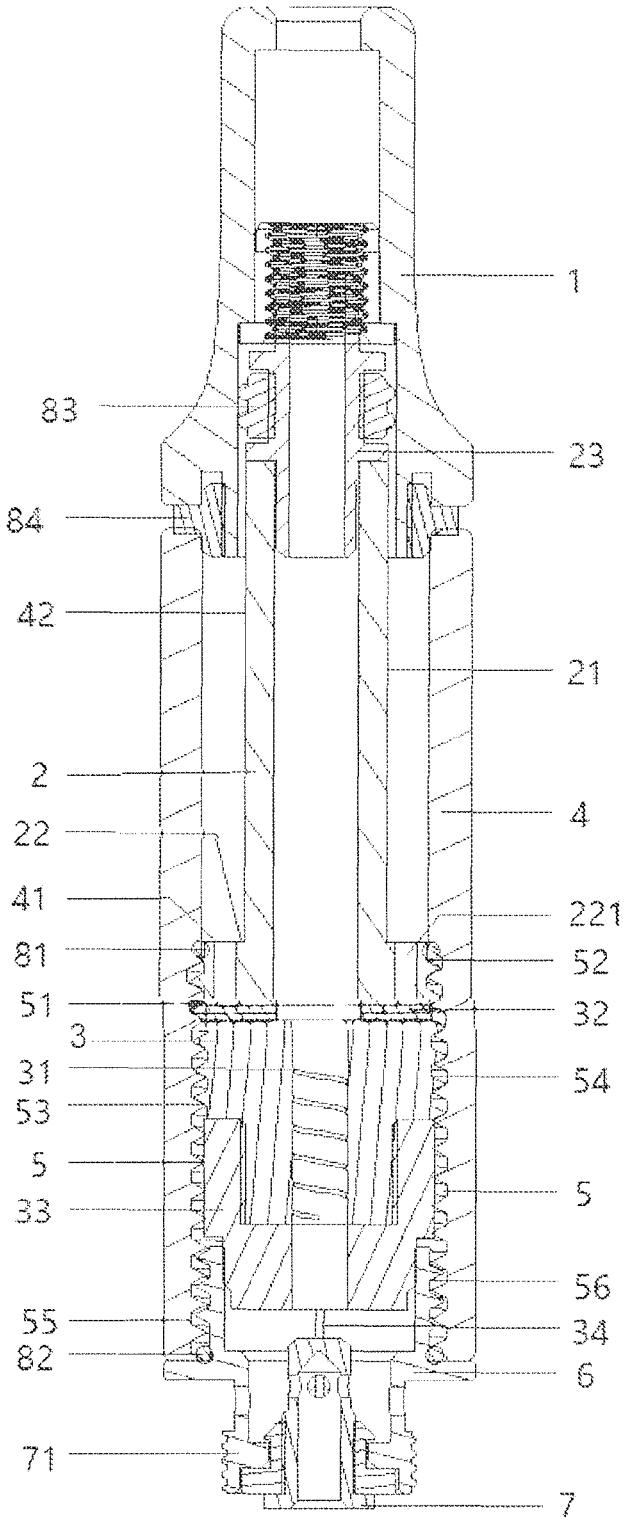
1
83
23
84
42
21
2
4
22
41
221
81
52
51
32
3
31
54
53
5
5
33
56
55
34
82
6
71
7

ELECTRONIC CIGARETTE

CROSS-REFERENCE TO RELATED APPLICATIONS

This application claims priority to Chinese Utility Model Application No. 201822021813.5, filed on Dec. 3, 2018 and entitled "A NOVEL ELECTRONIC CIGARETTE," the entire disclosure of which is hereby incorporated by reference for all proper purposes.

FIELD

This invention is related to electronic cigarettes. Specifically, but not intended to limit the invention, embodiments of the invention are related to a novel electronic cigarette.

BACKGROUND

Electronic cigarette is an electronic product that mimics cigarettes with same appearance, smoke, tastes, and feels. It is a kind of product that users can smoke vaporized nicotine and other substances by means of atomization. For conventional electronic cigarettes on the market, its glass guiding pipe is connected with its glass oil chamber by welding which will cause production difficulty and high defect rate. Because of a heating wire is fixed by silicone and a fixing element like screw is not firmly attached, assembling of the conventional electronic cigarette has became very difficult.

SUMMARY

An exemplary has a suction nozzle, a glass guiding pipe, an atomization core, an oil chamber, and an atomization core. An installing cavity is formed at a bottom of the oil chamber, and a first internal thread is arranged on an inner wall of the installing cavity. The glass guiding pipe has a pipe body and a flange sleeved and fixed on the pipe body, a first external thread connected with the first internal thread is arranged on a lateral side of the flange. The atomization core has a glass heating coil and an atomizing medium arranged at a top of the glass heating coil. A plurality of oil guiding holes are arranged on the flange, the plurality of oil guiding holes configured to guide oil to the atomization core. An opening corresponding to the oil guiding hole is arranged on an inner wall of the oil chamber. A through-hole corresponding to the pipe body is arranged through a lengthways in the oil chamber, the through-hole connected with the installing cavity.

BRIEF DESCRIPTION ON THE DRAWINGS

FIG. 1 is a side sectional view of an exemplary electronic cigarette.

DETAILED DESCRIPTION

In order to make purposes, technical solutions, and advantages of the embodiment in this utility model to be clearer, the following content provides a clear and a complete description of the technical solutions in accordance to the embodiment of this utility model. It should be clearly stated that the described embodiment as following is just a preferred embodiment and not all embodiments are described in this utility model. According to the embodiment of this utility model, all other embodiments obtained by the skilled person in the art without creative labor should fall within the protection scope of the utility model.

As shown in FIG. 1, a novel electronic cigarette of a preferred embodiment according to the utility model comprises a suction nozzle 1, a glass guiding pipe 2, an atomization core 3 and an oil chamber 4, an installing cavity 5 is formed at a bottom of the oil chamber 4, a first internal thread 51 is arranged on an inner wall of the installing cavity 5; the glass guiding pipe 2 comprises a pipe body 21 and a flange 22 sleeved and fixed on the pipe body 21, a first external thread 52 connected with the first internal thread 51 is arranged on a lateral side of the flange 22; the atomization core 3 comprises a glass heating coil 31 and an atomizing medium 32 arranged at a top of the glass heating coil 31, several oil guiding holes 221 are formed on the flange 22 to guide oil to the atomization core 3, an opening 41 corresponding to the oil guiding hole 221 is arranged on an inner wall of the oil chamber 4; a through-hole 42 corresponded to the pipe body 21 is formed through a lengthways in the oil chamber 4, the through-hole 42 is connected with the installing cavity 5; the glass guiding pipe is fixed by thread which can solve the problems such as production difficulty and high defect rate.

As shown in FIG. 1, a second internal thread 53 is also arranged on the inner wall of the installing cavity 5, a second external thread 54 connected with the second internal thread 53 is arranged on a lateral side of the glass heating coil 31; the glass heating coil is fixed through screws for achieving a more secure and easier assembling.

As shown in FIG. 1, a third internal thread 55 is arranged on the inner wall of the installing cavity 5, a screw element 6 is arranged on the oil chamber 4, a third external thread 56 connected with the third internal thread 55 is arranged on a lateral side of the screw element 6; the screw element is fixed through screws for achieving firmer and easier assembling.

As shown in FIG. 1, a first seal ring 81 is arranged at a threaded connection between the glass guiding pipe 2 and the installing cavity 5, a second seal ring 82 is arranged at a threaded connection between the screw element 6 and the installing cavity 5 to prevent oil leakage.

As shown in FIG. 1, an insulation ring 71 and an electrode 7 wrapped by the insulation ring 71 are arranged on the screw element 6 to prevent leakage of electricity.

As shown in FIG. 1, a pin 34 electrically connected with the electrode 7 is arranged on the glass heating coil 31 for facilitating assembling and production.

As shown in FIG. 1, a glass heating coil sleeve 33 is arranged between the glass heating coil 31 and the electrode 7 to prevent an impact of high temperature during an operation of the electrode 7.

As shown in FIG. 1, the atomizing medium 32 is organic cotton to facilitate oil absorption and to provide a better taste of the oil.

As shown in FIG. 1, a suction nozzle connector 23 is arranged on the glass guiding pipe 2, the suction nozzle 1 is detachably connected with the suction nozzle connector 23 by thread, a third seal ring 83 is arranged between the suction nozzle 1 and the suction nozzle connector 23 to facilitate assembling and to prevent oil leakage.

As shown in FIG. 1, a fourth seal ring 84 for sealing the oil chamber 4 is arranged between the oil chamber 4 and the suction nozzle 1 to prevent oil leakage.

It should be understood that any technician in this field of art can make improvements or changes according to the above description, and all such improvements and changes shall fall into the scope of protection of the claims attached to the utility model.

What is claimed is:

1. An electronic cigarette comprising:

a suction nozzle;

a glass guiding pipe;

an atomization core; and an oil chamber;

wherein an installing cavity is formed at a bottom of the oil chamber, and a first internal thread is arranged on an inner wall of the installing cavity;

the glass guiding pipe has a pipe body and a flange sleeved and fixed on the pipe body, a first external thread connected with the first internal thread is arranged on a lateral side of the flange;

the atomization core has a glass heating coil and an atomizing medium arranged at a top of the glass heating coil;

a plurality of oil guiding holes are arranged on the flange, the plurality of oil guiding holes configured to guide oil to the atomization core;

an opening corresponding to the oil guiding hole is arranged on an inner wall of the oil chamber; and a through-hole corresponding to the pipe body is arranged through a lengthways in the oil chamber, the through-hole connected with the installing cavity.

2. The electronic cigarette as claimed in claim 1, wherein a second internal thread is arranged on the inner wall of the installing cavity, a second external thread connected with the second internal thread is arranged on a lateral side of the glass heating coil.

3. The electronic cigarette as claimed in claim 1, wherein a third internal thread is arranged on the inner wall of the installing cavity, a screw element is arranged on the oil chamber, and a third external thread connected with the third internal thread is arranged on a lateral side of the screw element.

4. The electronic cigarette as claimed in claim 3, wherein a first seal ring is arranged at a threaded connection between the glass guiding pipe and the installing cavity, a second seal ring is arranged at a threaded connection between the screw element and the installing cavity.

5. The electronic cigarette as claimed in claim 3, wherein an insulation ring and an electrode wrapped by the insulation ring are arranged on the screw element.

6. The electronic cigarette as claimed in claim 5, wherein a pin electrically connected with the electrode is arranged on the glass heating coil.

7. The electronic cigarette as claimed in claim 6, wherein a glass heating coil sleeve is arranged between the glass heating coil and the electrode.

8. The electronic cigarette as claimed in claim 1, wherein the atomizing medium is organic cotton.

9. The electronic cigarette as claimed in claim 8, wherein a suction nozzle connector is arranged on the glass guiding pipe, the suction nozzle is detachably connected with the suction nozzle connector, and a third seal ring is arranged at a connection between the suction nozzle and the suction nozzle connector.

10. The electronic cigarette as claimed in claim 1, wherein a fourth seal ring for sealing the oil chamber is arranged between the oil chamber and the suction nozzle.

* * * * *